US005263343A

United States Patent [19]

Lee

[11] Patent Number: 5,263,343

[45] Date of Patent: Nov. 23, 1993

[54] INSULATING STRUCTURE OF A WASHING MACHINE HAVING A WATER CONTAINER COVER

[75] Inventor: Kyu C. Lee, Suweon, Rep. of Korea

[73] Assignee: Samsung Electronics Co., Ltd., Suwon, Rep. of Korea

[21] Appl. No.: 892,793

[22] Filed: Jun. 3, 1992

[30] Foreign Application Priority Data

Jun. 12, 1991 [KR] Rep. of Korea ..... 91-8682[U]

[51] Int. Cl.[5] ..... D06F 39/00

[52] U.S. Cl. ..... 68/15

[58] Field of Search ..... 68/3 R, 15; 220/901, 220/451, 453, 464; 126/344, 350 C

[56] References Cited

U.S. PATENT DOCUMENTS 205,199 6/1878 Merrell ..... 220/451
373,703 11/1887 Wagg ..... 220/451 X
2,151,354 3/1939 Osuch ..... 68/15 X
2,258,215 10/1941 Paulson et al. ..... 68/15 X
3,122,259 2/1964 Meesen ..... 220/901 X
3,948,406 4/1976 Papanicolaou et al. ..... 220/901 X

FOREIGN PATENT DOCUMENTS 2-75087 8/1990 Japan .

*Primary Examiner*—Philip R. Coe
*Attorney, Agent, or Firm*—Burns, Doane, Swecker & Mathis

[57] ABSTRACT

A fully automatic clothes washing machine having thermal and sound insulating components mounted on the outer wall of a water container, in which the insulating wall portion includes a plurality of rib members spaced at predetermined intervals from one another, with the rib members arranged in the form of a lattice-work that forms recesses in which the insulating components are mounted.

9 Claims, 3 Drawing Sheets

INSULATING STRUCTURE OF A WASHING MACHINE HAVING A WATER CONTAINER COVER

BACKGROUND OF THE INVENTION

The present invention is related to providing a fully automatic clothes washing machine consisting in part of a water container equipped with a heating apparatus used for washing clothing in hot or boiling water.

PRIOR ART

There is a typical example known in the washing machine industry as Japan Utility Model Laid Open Publication No. 2/75087. This publication discloses a washing machine consisting of a water container mounted within its body and a drying container which is positioned in the water container so as to be freely rotated, in which a heating element with a thermal conductivity is located in the water container, an electrical heater is wound around the heating member in a coil form, and the end of the electrical heater passes through the water container so that it can be thermally connected to a temperature adjusting device.

Generally, modern washing machines offer two choices for washing clothing: in warm water and in boiling water of about 100 degrees centigrade, dependent upon cultural characteristics of countries or regions. Thus, most modern washing machines are provided with an electrical heating apparatus for heating the wash water to over a predetermined temperature and maintaining that temperature for a predetermined period of time. The heating apparatus must be manipulated a few times while the desired temperature is achieved, or the control mechanism must be adjusted.

Furthermore, this type of washing machine is not provided with a separate device for providing thermal insulation. It is thus difficult for the machine to maintain a predetermined temperature for a predetermined period of time. Also, a washing machine which boils clothing in order to provide the sterilization/insecticide benefits has not been developed. Furthermore, thermal insulating structure for a washing machine has not yet been suggested.

On the other hand, there is a tendency to promote household electric appliances such as fully automatic clothes washers as labor saving devices, especially in this era of increasing use of remote control operations provided by wireless communication equipment in addition to the automatic equipment operations. In consideration of this trend, automatic washing machines will become more useful if they are able to perform the procedures of sterilizing, removing insects, washing, dehydrating and drying clothing in a fully automatic manner.

In order to accomplish this, it is necessary to adapt the water container of a washing machine to become a thermal insulating structure in order to boil clothes at a high temperature level of almost 100° C. and then accomplish the dehydration procedure as well as to prevent the heat loss in order to reduce unnecessary power consumption. Also, a washing machine may be provided with a thermal insulating structure having a sound absorption quality for the purpose of reducing the noise generated during the dehydrating cycle. It is noted that a washing machine having two positive effects of reducing the power consumption and reducing noise can be realized.

An object of the present invention is to provide a fully automatic clothes washing machine with an insulating component mounted on the outer wall of the water container.

Another object of the present invention is to provide a fully automatic clothes washing machine with an insulating component mounted on the outer wall of the water container which will help keep heated wash water at a predetermined temperature, thereby preventing unnecessary power consumption.

Still another object of the present invention is to provide a fully automatic clothes washing machine with an insulative component mounted on the outer wall of the water container to absorb the noises created during the machine's operation.

Still another object of the present invention is to make it easier for the user to utilize the benefits of the fully automatic clothes washing machine.

SUMMARY OF THE INVENTION

The present invention comprises a fully automatic clothes washing machine providing an insulative component mounted on the outer wall of a water container, in which the insulative wall portion includes a plurality of ribs spaced at a predetermined interval from one another, and the ribs are arranged in the form of a lattice pattern, thereby producing two effects; heat retention and the noise suppression.

BRIEF DESCRIPTION OF THE DRAWINGS

The present invention will now be explained in detail with reference to the attached drawings; in which.

DETAILED DESCRIPTION OF THE PREFERRED EMBODIMENTS

Figure 1:
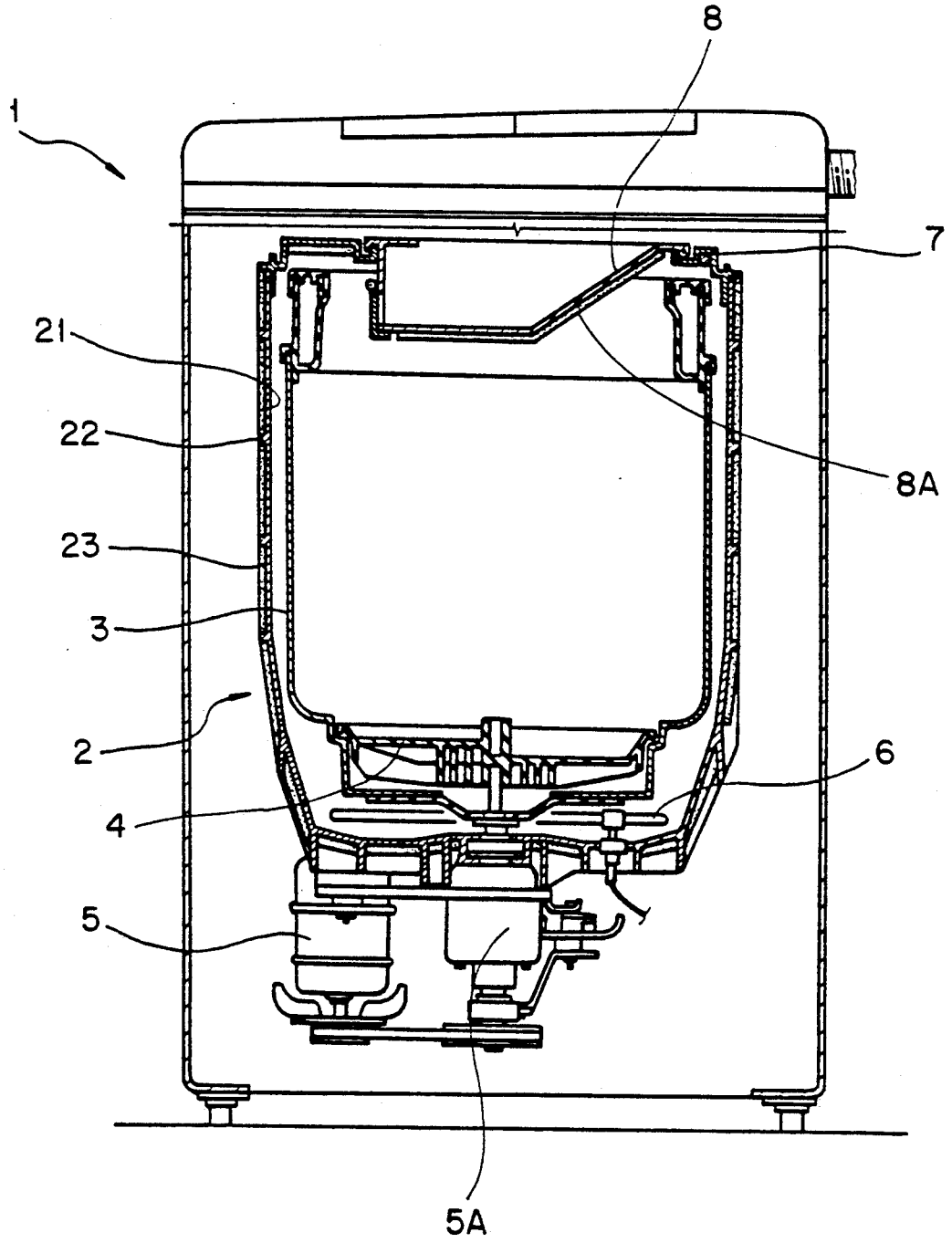
FIG. 1 is a vertical cross-sectional view illustrating a fully automatic clothes washing machine according to the present invention.

FIG. 1 represents a fully automatic clothes washing machine 1 according to the present invention, which includes tub. The tub is comprised of a water container body 2 which retains washing-water therein and a washing tank 3 which receives clothing, and which is spaced from the outer portion. The water container body 2 includes a heating apparatus 6 mounted between its inner bottom surface and the outer bottom surface of the washing tank 3. The washing tank 3 has a pulsator or agitator 4 positioned therein, which is connected to a gear box 5A which is operated by the driving force of a motor 5. On the upper portion of the water container body 2 there is formed an opening/closing device 8 which functions as a cover which is supported by means of a supporting member 7 at the upper portion of the water container.

The water container body 2 includes a cylindrical plate 21 which forms an outer wall portion around its perimeter and outwardly projecting ribs 22 integrally, formed on the cylindrical plate 21 in the form of a lattice-work frame so as to project outwardly from an outer cylindrical surface of the plate 21. Into a plurality of recesses formed by the lattice-work frame, insulative members 23 are affixed by the use of strong adhesive materials in order to form an insulating structure.

It will thus be appreciated that the recesses are closed inwardly by recessed surface portions 30, and that the ribs are integral with, i.e., of one-piece construction with, those recessed surface portions 30 and project outwardly from peripheral edges 32 of the recess.

The supporting member 7 removably mounted on the upper portion of the water container body 2 does not have an insulating function. The opening/closing device 8 is provided with an insulating plate 8A attached by means of strong adhesive materials to its bottom surface, its shape being the same as that of the opening/-closing device 8. It can conform to the shape of the opening/closing device 8 without being limited by the predetermined shape. In this embodiment, the concave portion formed on the upper portion of the opening/-closing device 8 may be modified with the addition of an insulating member at its upper surface if necessary.

Figure 2:
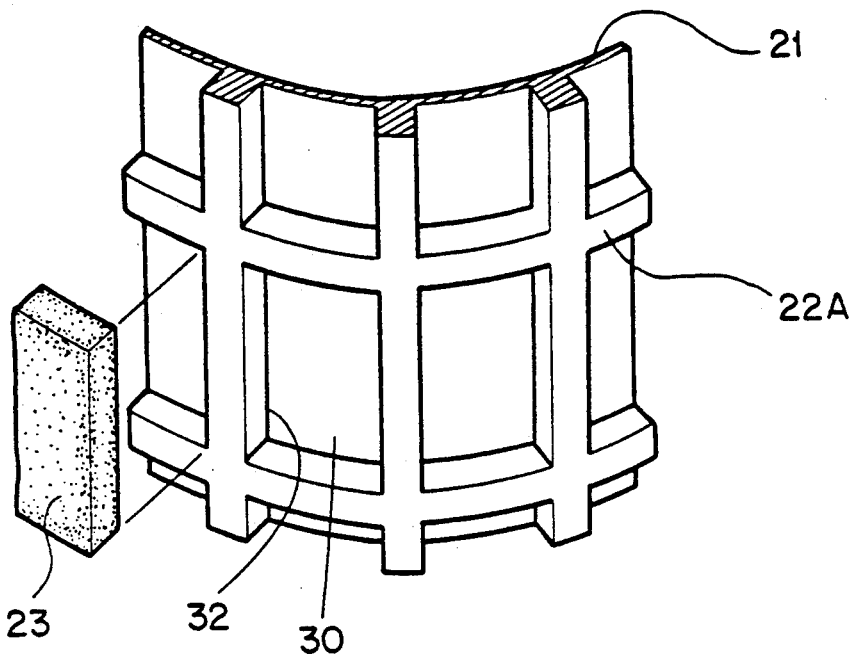
FIG. 2 is a fragmentary perspective view illustrating the projecting ribs of a latticed frame integrally mounted on the water container of a fully automatic clothes washing machine according to one embodiment of the present invention.
Figure 3:
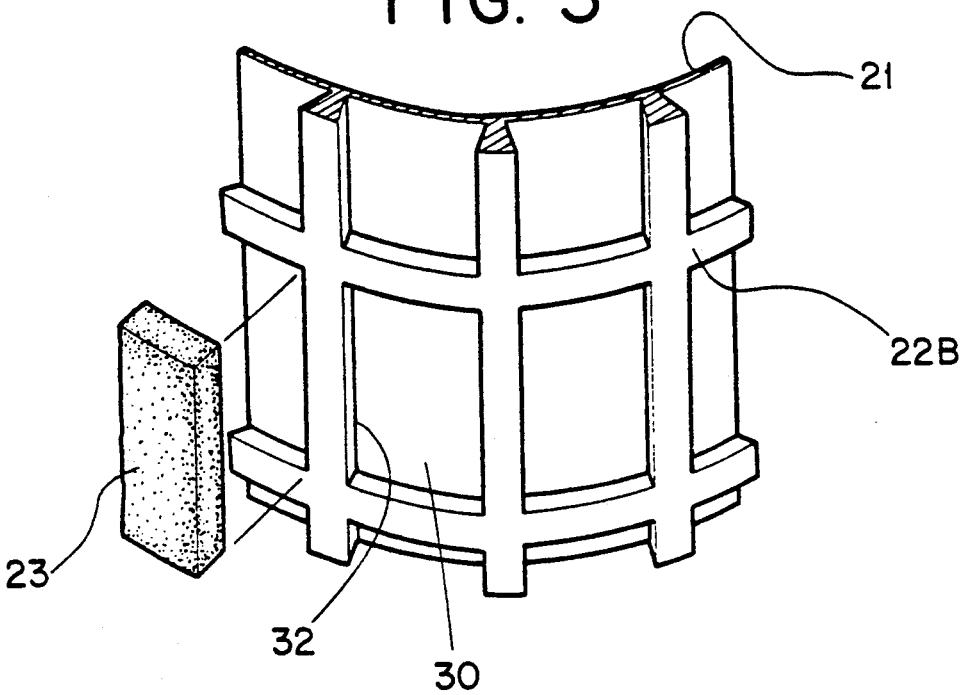
FIG. 3 is view similar to FIG. 2 illustrating another embodiment of a projecting rib according to the present invention.
Figure 4:
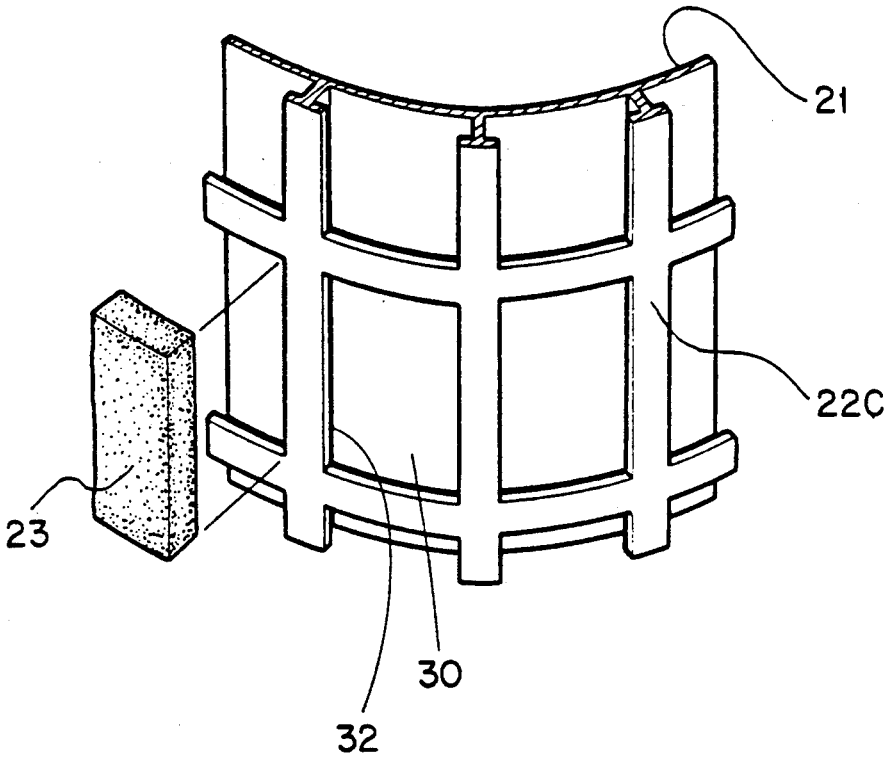
FIG. 4 is view similar to FIG. 2 illustrating still another embodiment of a projecting rib according to the present invention.

FIGS. 2, 3 and 4 show the shapes of a plurality of projecting ribs forming the lattice-work frame of the water container body 2 which is made of synthetic resin material. Referring to FIG. 2, a plurality of projecting ribs 22A are formed in a lattice-work pattern on the cylindrical plate 21 of the water container body 2, in which the projecting rib 22A appears as a rectangular shape in a cross-sectional view. An insulating panel component 23, in the form of a rectangle, is attached by means of strong adhesive materials between the projecting ribs. Similarly, the lattice work frame may be constructed to have a plurality of projecting ribs 22B of V-shaped or dove-tail shaped cross section as shown in FIG. 3 or a plurality of projecting ribs 22C of T-shaped cross-section as shown in FIG. 4.

Thus, the spacing between adjacent ribs is smaller at a first radial distance from the plate 21 than at a second radial distance which is shorter than the first radial distance. As a result, ribs 22B and 22C permit each of the insulating components to be pressed/seated into a secure position in the lattice-work frame, thereby eliminating the need for an adhesive.

As described above, according to the present invention, a fully automatic clothes washing machine performs an insulating function to minimize the electric power consumption and to suppress noise generated by the automatic clothes washing machine when it is in operation.

What is claimed is:

1. A clothes washing machine comprising a tub for containing wash water, a heater for heating the water, and an agitator for agitating the water, said tub including an outer surface having a plurality of outwardly open recesses, said recesses being inwardly closed by recessed surface portions of said outer surface and being spaced apart by ribs projecting outwardly from peripheral edges of said recessed surface portions, and thermal insulating panels disposed in respective ones of said recesses.

2. A clothes washing machine according to claim 1, wherein said recessed surface portions are of one-piece construction with said ribs.

3. A clothes washing machine according to claim 2, wherein said tub comprises a tank in which said agitator is disposed, and a container surrounding said tank to form a space therebetween in which said heater is disposed, said outer surface being formed by said container.

4. A clothes washing machine according to claim 3, wherein said ribs are of lattice-work configuration, said recesses being rectangular.

5. A clothes washing machine according to claim 4, wherein said outer surface is cylindrical.

6. A clothes washing machine according to claim 1, wherein said panels are secured to said outer surface by adhesive.

7. A clothes washing machine according to claim 1, wherein said tub comprises a tank in which said agitator is disposed, and a container surrounding said tank to form a space therebetween in which said heater is disposed, said outer surface being formed by said container.

8. A clothes washing machine according to claim 7, wherein said container is formed of a synthetic resin.

9. A clothes washing machine comprising a tank and a water container disposed inside of said tank for containing hot wash water, a heater for heating the water, an agitator for agitating the water, said tank including a cylindrical wall having on a surface thereof a plurality of ribs forming a plurality of recesses, and a plurality of thermal insulating members mounted in said recesses, wherein the spacing between adjacent ribs is smaller at a first distance from said surface than at a second distance which is shorter than said first distance, for retaining said thermal insulating members in place.

* * * * *